United States Patent [19]

Riley

[11] Patent Number: 4,503,630

[45] Date of Patent: Mar. 12, 1985

[54] DITCH DIGGING MACHINE

[76] Inventor: Terrence H. Riley, P.O. Box 987, Lehigh Acres, Fla. 33936

[21] Appl. No.: 532,494

[22] Filed: Sep. 15, 1983

[51] Int. Cl.[3] ..... E02F 5/08

[52] U.S. Cl. ..... 37/94; 37/189; 56/320.1; 172/43; 172/112

[58] Field of Search ..... 37/91–97, 37/189, 142 R, 142 A; 172/661, 42, 43, 76–78, 483, 501, 543, 544, 548; 254/103; 56/17.1, 17.2, 17.4, 320.1; 144/2 N

[56] References Cited

U.S. PATENT DOCUMENTS

| | | | |
|---|---|---|---|
| 1,282,786 | 10/1918 | Entz | 254/103 X |
| 1,313,242 | 8/1919 | Ashley | 172/483 X |
| 1,538,565 | 5/1925 | Löken | 37/94 |
| 1,858,360 | 5/1932 | Cruse | 37/94 |
| 2,020,524 | 11/1935 | Smithburn | 172/544 |
| 2,051,443 | 8/1936 | Gravely | 172/43 |
| 2,054,129 | 9/1936 | Kelsey | 37/189 |
| 2,679,703 | 6/1954 | Borel | 37/92 |
| 2,691,926 | 10/1954 | Jackson | 172/77 X |
| 2,907,163 | 10/1959 | Mollohan | 56/17.1 X |
| 2,979,837 | 4/1961 | Hunter | 37/94 |
| 3,041,750 | 7/1962 | Garnand | 37/92 |
| 3,342,532 | 9/1967 | Krekeler | 37/142 A X |
| 3,570,225 | 3/1971 | Miskiewicz | 56/17.4 |
| 4,271,879 | 6/1981 | Shivers, Jr. et al. | 144/2 N |

FOREIGN PATENT DOCUMENTS

| | | | |
|---|---|---|---|
| 993083 | 10/1951 | France | 37/94 |
| 623902 | 5/1949 | United Kingdom . | |

*Primary Examiner*—Edgar S. Burr
*Assistant Examiner*—Moshe I. Cohen
*Attorney, Agent, or Firm*—A. W. Fisher, III

[57] ABSTRACT

A ditch digging machine comprising a frame including a pair of vertical posts and a cross bar connecting the upper ends of said vertical posts, wheels supporting the lower ends of the vertical posts, a housing including a convex hood having forward and rear end plates extending downwardly from opposite ends thereof, the forward and rear end plates each having a sleeve attached thereto to engage the vertical posts, a vertical side shield extending between the opposite end plates, a motor support platform extending outwardly from the vertical side shield, an adjustable vertical lift means for raising and lowering the housing relative to the frame, a motor mounted on the motor support platform having a shaft extending through the vertical side shield, and a cutting blade assembly rotatably mounted on the shaft substantially parallel to the vertical side shield within the convex hood and the end walls; the cutting blade assembly configured to be lowered with the housing for ground engagement to cut a slit trench therein, and a flexible safety guard extending outwardly from the convex hook opposite the vertical side to prevent debris thrown by the cutting action of the cutting blade assembly from being thrown from the ditch digging machine.

6 Claims, 4 Drawing Figures

DITCH DIGGING MACHINE

BACKGROUND OF THE INVENTION

1. Field of the Invention

A ditch digging machine to form or cut a slit trench.

2. Description of the Prior Art

A number of ditch digging machines have been designed for forming or cutting a slit trench. Unfortunately these machines are often limited in performance due to weight and size restrictions. Moreover, these machines commonly present safety problems due to throwing debris from the machines themselves.

Examples of the prior art are disclosed in U.S. Pat. Nos.: 1,282,786; 1,313,242; 1,538,565; 1,858,360; 2,020,524; 2,051,443; 2,054,129; 2,679,703; 2,691,926: 2,907,163; 2,979,837; 3,041,750; 3,342,532; 3,570,225; Great Britain Pat. No. 623,902; and France Pat. No. 993,083.

SUMMARY OF THE INVENTION

The present invention relates to a ditch digging machine comprising a frame, housing, vertical lift assembly, blade assembly and motor.

The frame comprises a pair of substantially vertical post held in fixed spaced relationship relative to each other by a substantially horizontal interconnecting cross bar. The lower portion of the forward vertical post is coupled to a substantially horizontal axle having a pair of forward wheels rotatably connected to opposite ends thereof. The lower portion of the rear vertical post is interconnected to the rear wheel by swivel coupling means. Extending vertically upward from the horizontal axle is a forward safety shield.

The housing comprises a convex, arcuate hood having substantially vertical forward and rear end plates extending downwardly from opposite ends thereof in combination with a vertical side shield. A substantially horizontal motor support platform extends outwardly from the lower portion of the vertical side plate to operatively support the motor. In addition a pair of hollow sleeves are attached to the end plates to operatively engage the vertical posts to permit vertical adjustment of the housing relative to the frame. The housing further includes a flexible safety guard connected or coupled to the outer side of the convex, arcuate hood.

The vertical lift means comprises actuator handle pivotally coupled to the frame and actuator lever pivotally coupled between the actuator hand and motor support platform. The vertical lift assembly further includes a pair of bias means or springs interconnected between the horizontal motor support platform and the horizontal interconnecting cross bar to assist in the vertical adjustment of the motor and cutting blade assembly.

The motor includes a drive shaft which extends the vertical side shield to operatively engage the cutting blade assembly includes an inner hub member including channels intersecting the periphery of the inner hub member.

The inner hub member receives an outer hub member which covers the channels.

In operation the motor is started with the housing and blade assembly in an elevated position. After positioning the ditch digging machine over the path of the intended ditch, the housing is gradually lowered by raising the actuator handle until the desired depth is attained. The ditch digging machine is then pushed forward as the blades rotate. The blades sling the dirt and sod upwardly against the convex hood with sufficient force that the material is deflected against the interior surface of the flexible safety guard where it falls along side of the ditch.

The vertical side shield, forward safety shield and flexible safety guard prevent debris from being thrown from the ditch digging machine.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
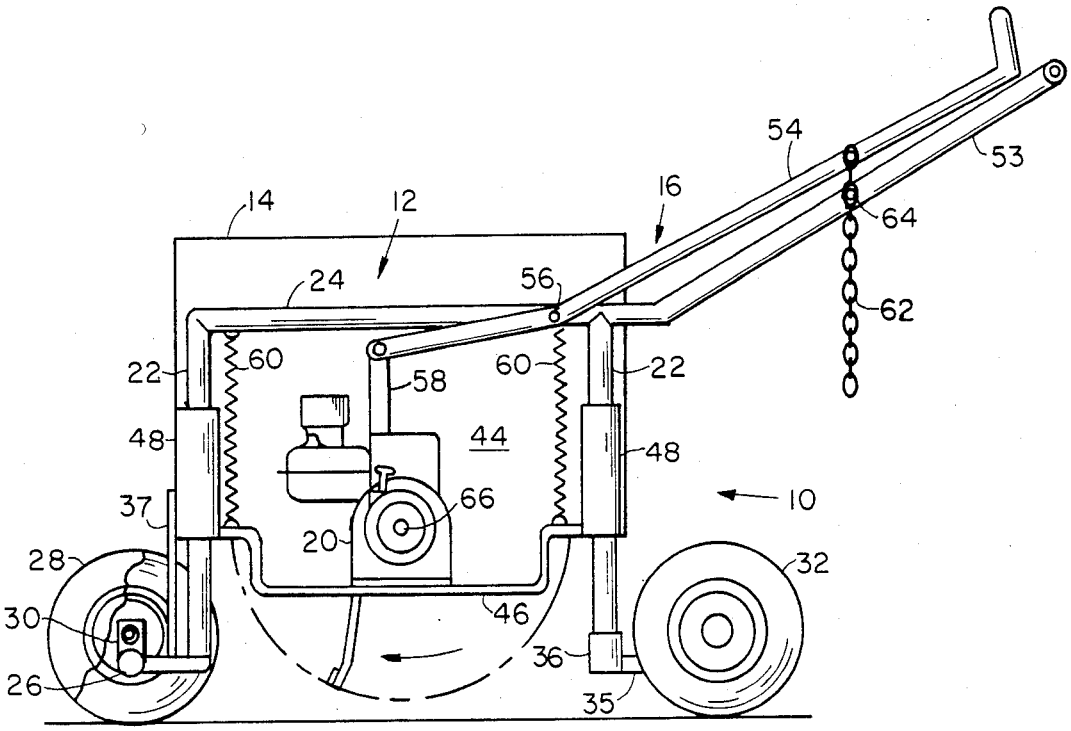
FIG. 1 is a side view of the ditch digging machine.
Figure 2:
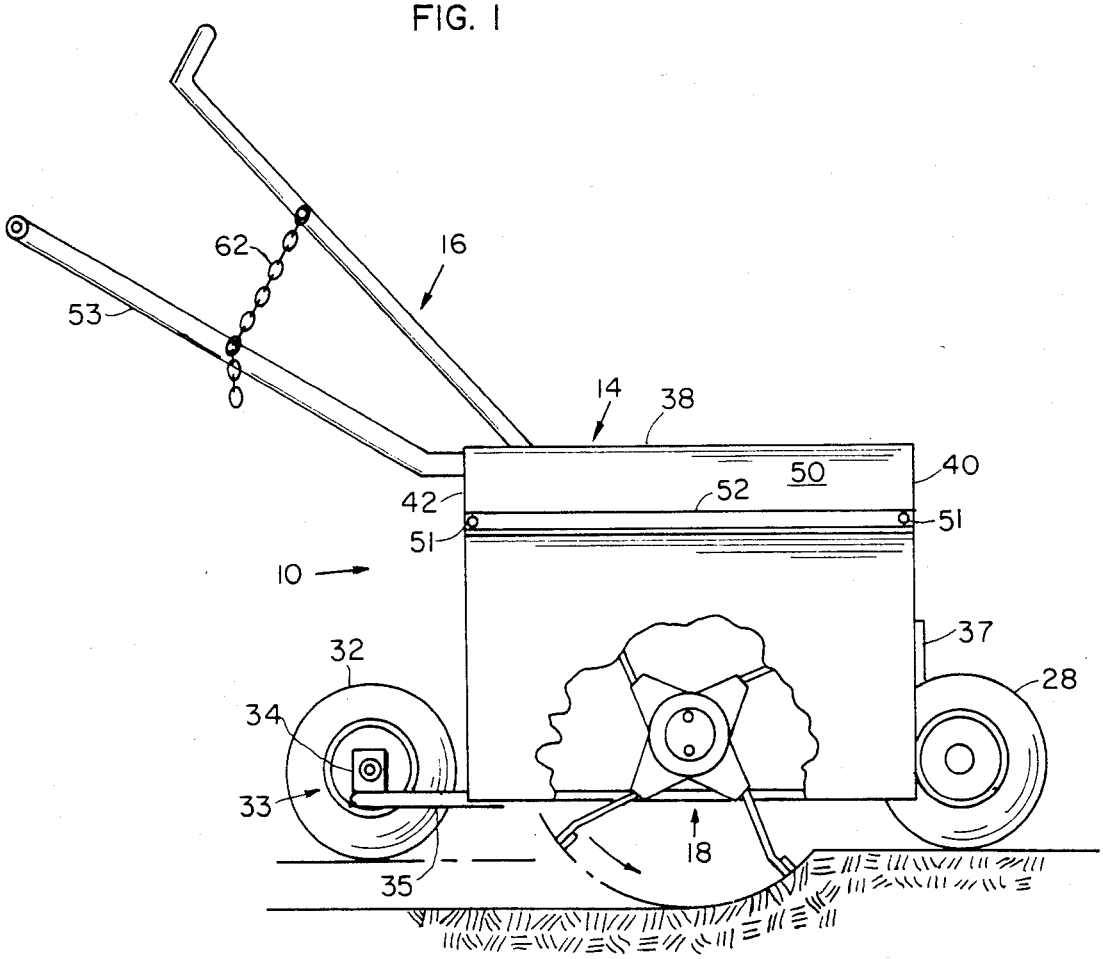
FIG. 2 is a partial cross sectional view of the opposite side of the ditch digging machine.
Figure 3:
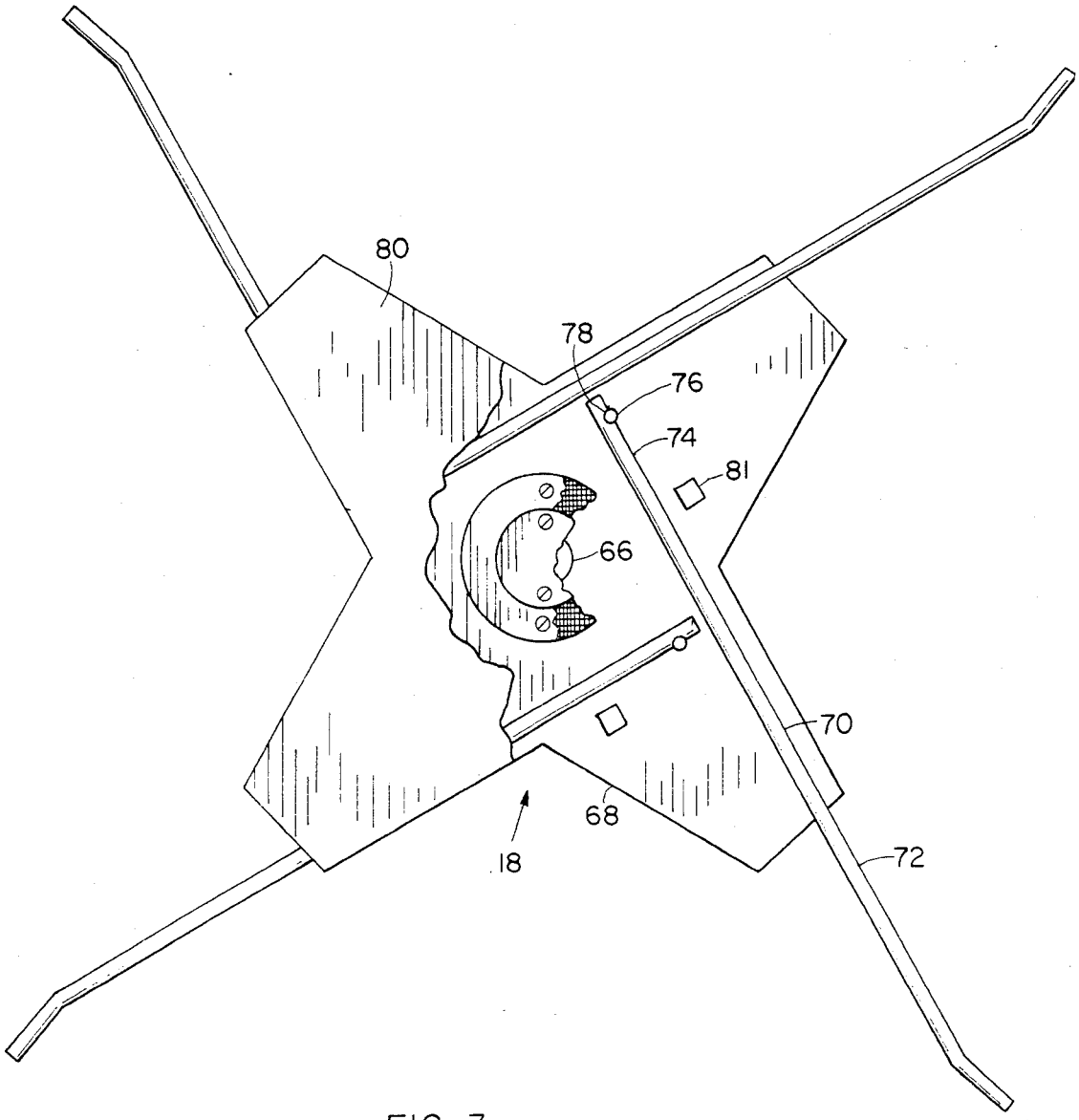
FIG. 3 is a detailed view of the digging blade assembly.
Figure 4:
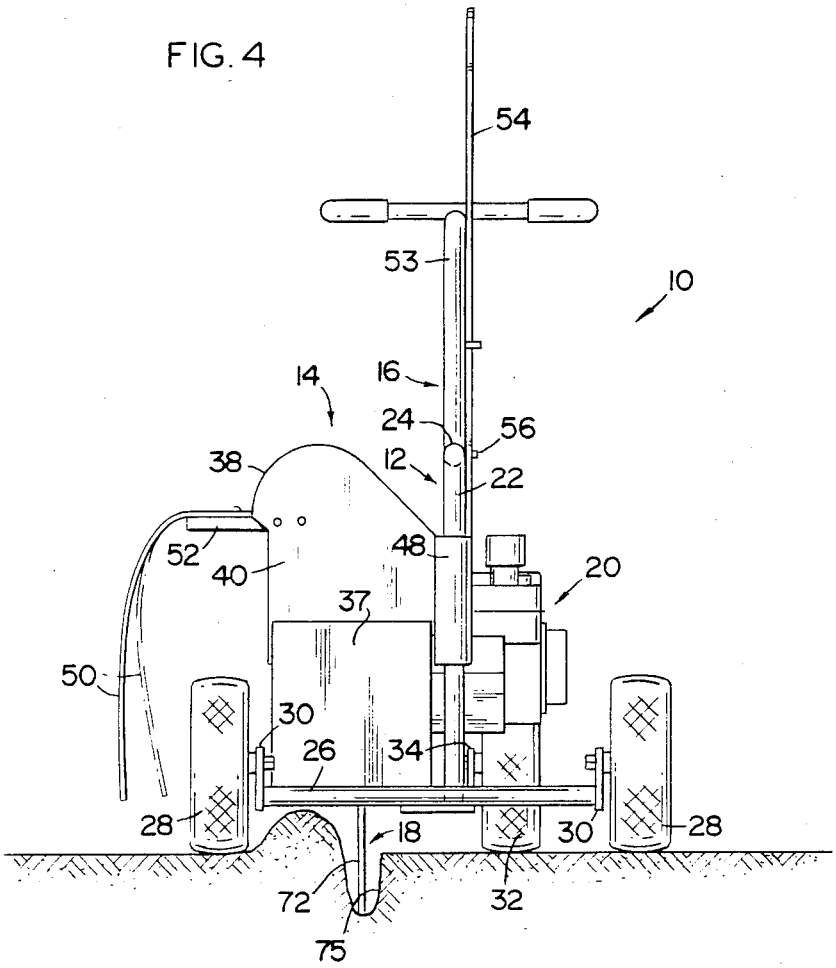
FIG. 4 is a cross-sectional rear view of the ditch digging machine.

As best shown in FIGS. 1, 2 and 4, the present invention relates to a ditch digging machine generally indicated as 10. More specifically, the ditch digging machine 10 comprises a frame, housing, vertical lift assembly, blade assembly and motor generally indicated as 12, 14, 16, 18 and 20 respectively.

As best shown in FIG. 1, the frame 12 comprises a pair of substantially vertical posts 22 held in fixed spaced relationship relative to each other by a substantially horizontal interconnecting cross bar 24. The lower portion of the forward vertical post 22 is coupled to a substantially horizontal axle 26 having a pair of forward wheels 28 rotatably connected to opposite ends thereof. The forward wheels 28 are coupled to the horizontal axle 26 by connecting plates 30 extending upwardly from the horizontal axle 26 such that the centerline axis of the horizontal axle 26 is disposed beneath the centerline axis of the forward wheels 28 to permit greater ditch depth as more fully described hereinafter. The lower portion of the rear vertical post 22 is interconnected to the rear wheel 32 by swivel coupling means 33 including a connector plate 34 extending upwardly from horizontal member 35 which in turn is pivotally attached to rear vertical post 22 by a sleeve 36. Extending vertically upward from the horizontal axle 26 is a forward safety shield 37.

The housing 14 comprises a convex, arcuate hood 38 having substantially vertical forward and rear end plates 40 and 42 extending downwardly from opposite ends thereof in combination with a vertical side shield 44. A substantially horizontal motor support platform 46 extends outwardly from the lower portion of the vertical side plate 44 to operatively support the motor 20. In addition, a pair of hollow sleeves 48 are attached to the end plates 40 and 42 to operatively engage the vertical posts 22 to permit vertical adjustment of the housing 14 relative to the frame 12. The housing 14 further includes a flexible safety guard 50 connected or coupled to the outer side of the convex, arcuate hood 38. An extension member 52 extending the length of the hood 38 by parallel elements 51 extending outwardly from the hood 38, operatively supports the flexible safety guard 50 outwardly of the right of the housing 14, blade assembly 18 and motor 20.

As best shown in FIG. 4, the longitudinal alignment of the vertical posts 22 is substantially centered on the horizontal axle 26 such that the cutting blade assembly 18 is offset relative to the forward wheels 28. A directional control handle 53 extends reardly from the cross bar 24.

As shown is FIG. 1, the vertical lift means 16 comprises actuator handle 54 pivotally coupled to the frame 12 by means of fastening means 56 and an actuator lever 58 pivotally coupled between the actuator hand 54 and motor support platform 46. The vertical lift assembly 16 further includes a pair of bias means or springs 60 interconnected between the horizontal interconnecting cross bar 24 to assist in the vertical adjustment of the motor 20, housing 14 and cutting blade assembly 18. A retainer means comprising a chain 62 or the like is attached in the actuator handle 54. The chain 62 is selectively attachable to a securing pin 64 attached to the directional control handle 53 to selectively control the height of the motor 20 and cutting blade assembly 18 relative to the frame 12.

The motor 20 includes a drive shaft 66 which extends through the vertical side shield 44 to operatively engage the cutting blade assembly 18. The cutting blade assembly 18 includes a star shaped inner hub member 68. Formed on surface of the inner hub member 68 adjacent each side are a plurality of channels 70 intersecting the periphery of the inner hub member 68. Fitted in each channel 70 is a blade 72 which is anchored at the inner portion 74 thereof by a pin 76 engaging a cutout portion 78 formed on the blade 72. The inner hub member 68 receives an outer hub member 80 which covers the channels 70 and secured by a pair of stud bolts 81. The cutting blade assembly 18 includes clutch plate and the cover plate or friction or clutch disks (not shown).

In operation the motor 20 is started with the housing 14, and cutting blade assembly 18 in an elevated position. After positioning the ditch digging machine 10 over the path of the intended ditch, the housing 14 is gradually lowered by raising the actuator handle 54 until the desired depth is attained. The chain 62 is then secured to the pin 64. The ditch digging machine 10 is then pushed forward as the blades 72 rotate. The blades 72 sling the dirt and sod upwardly against the convex hood 38 with sufficient force that the material is deflected to one side where it falls along one side of the ditch. The vertical side shield 44, forward safety shield 37 and flexible safety guard 50 prevent debris from being thrown from the ditch digging machine 10. As best shown in FIG. 4 the force of the material is deflected to one side forming substantially parellel mound with respect to the trench or slit cut by the blade assembly 18. Particularly important rocks and other solid materials are encountered. Since the flexible safety guard 50 comprises a resilient or flexible member, the outward force of the rocks or other solid materials are absorbed by the flexible safety guard 50 preventing it from being thrown into the blade assembly 18. The flexible safety guard 50 may also be flexed upwardly to permit access to the cutting blade assembly 18 for maintenance.

As previously indicated, the axle 26 is offset downwardly relative to the rotational point of the wheels 30 and 32. As a result, sleeves 48 may be moved vertically downward on post 22 past the center axis of the wheels 30 and 32, thus, permitting the blades 72 to dig a deeper trench or slit 25.

It will thus be seen that the objects set forth above, and those made apparent from the preceding description are afficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, what is claimed is:

1. A ditch digging machine comprising: a frame including a forward and rear vertical post and a cross bar connecting the upper ends of said vertical posts; wheels supporting the lower ends of said vertical posts; a housing to at least partially enclose a cutting blade assembly; said housing including a convex hood having forward and rear end plates extending downwardly from opposite ends thereof; said forward and rear end plates each having a sleeve attachment thereto to engage said vertical posts, a vertical side shield extending between said opposite end plates, a motor supporting platform extending outwardly from said vertical side shield to support a motor thereon, and adjusting vertical lift means for raising and lowering said housing relative to said frame, a bias means coupled between said motor support platform and said frame means to assist the vertical adjustment of said motor relative to said frame, said motor mounted on said motor support platform having a substantially horizontal motor shaft extending through said vertical side shield, and a flexible safety guard connected to said convex hood opposite said vertical safety shield disposed to deflect excavated debris from said cutting blade assembly against said convex hood, said flexible safety guard comprising a resilient member to at least partially absorb the energy of the excavated debris from said cutting blade assembly, said flexible safety guard operatively supported by an extending member extending outwardly from said convex hood to at least partially enclose one of said forward wheels, the lower edge of said resilient member extending at or below said substantially horizontal motor shaft, said cutting blade assembly rotatably mounted on said substantially horizontal motor shaft substantially parallel to said vertical side shield within said convex hood and said forward and rear end plates; said cutting blade assembly configured to be lowered with said housing for ground engagement to cut a trench therein; said wheels including a pair of forward wheels being rotatably attached to opposite ends of a substantially horizontal axle coupled to a lower portion of said forward vertical post and a rear wheel pivotally coupled to the lower portion of said rear vertical post by a swivel coupling means including a sleeve pivotally attached to the lower portion of said rear vertical post.

2. The ditch digging machine of claim 1 wherein a forward safety shield extends vertically upward from said substantially horizontal axle.

3. The ditch digging machine of claim 1 wherein the longitudinal alignment of said vertical posts is substantially centered on said substantially horizontal axle such that said cutting blade assembly is offset relative to said forward wheels.

4. The ditch digging machine of claim 1 wherein said cutting blade assembly comprises an inner hub member having a plurality of channels formed therein to receive a corresponding plurality of blades and an outer hub member secured to said inner hub member to retain said plurality of blades therebetween.

5. The ditch digging machine of claim 4 wherein said blades are anchored to said inner hub member by a pin engaging a cut out portion formed on the inner portion of each side blade.

6. The ditch digging machine of claim 5 wherein said inner and outer hub members are substantially star shaped.

* * * * *